US008618454B2

(12) United States Patent
Rich

(10) Patent No.: US 8,618,454 B2
(45) Date of Patent: Dec. 31, 2013

(54) MICROWAVABLE CONTAINER

(76) Inventor: Hilary Rich, Los Angeles, CA (US)

( * ) Notice: Subject to any disclaimer, the term of this patent is extended or adjusted under 35 U.S.C. 154(b) by 693 days.

(21) Appl. No.: 12/656,920

(22) Filed: Feb. 19, 2010

(65) Prior Publication Data

US 2011/0204047 A1 Aug. 25, 2011

(51) Int. Cl.
*H05B 6/80* (2006.01)

(52) U.S. Cl.
USPC ..... 219/732; 220/201; 220/495

(58) Field of Classification Search
USPC ..... 219/732; 220/201, 495
See application file for complete search history.

(56) References Cited

U.S. PATENT DOCUMENTS 3,863,045 A * 1/1975 Rosenberry ..... 219/722
4,450,334 A * 5/1984 Bowen et al. ..... 219/730
5,396,051 A * 3/1995 Kuhn et al. ..... 219/679
5,587,099 A * 12/1996 Kuhn et al. ..... 219/728
6,803,551 B2 * 10/2004 Kim et al. ..... 219/731
2009/0078125 A1 * 3/2009 Pawlick et al. ..... 99/448

* cited by examiner

*Primary Examiner* — A. Sefer
(74) *Attorney, Agent, or Firm* — Bacon & Thomas, PLLC

(57) ABSTRACT

A microwavable container for receiving food and to be put into a microwave oven for microwave heating. The microwave oven includes a support surface for supporting the microwavable container placed therein. The microwavable container is composed of a main body and a support member. The main body includes an internal bottom wall and an internal peripheral wall, both of which jointly define a chamber for receiving the food. The support member is provided with a predetermined height and located at a bottom side of the main body in such a way that a gap is formed between the internal bottom wall of the main body and the support surface of the microwave oven while the container is placed into the microwave oven. In this way, the microwave can pass through the gap to heat where the food is close to the internal bottom wall of the container.

10 Claims, 3 Drawing Sheets

MICROWAVABLE CONTAINER

BACKGROUND OF THE INVENTION

1. Field of the Invention

The present invention relates generally to microwavable containers, and more particularly, to a microwavable container where food can be uniformly heated.

2. Description of the Related Art

A conventional microwavable container is a box having a tank for receiving the food. The box is substantially flat at its bottom side and can directly contact an internal bottom side of a microwave oven.

When the aforesaid box is put along with the food into the microwave oven for heating, the microwave keeps reflection in the oven and penetrates through the food to oscillate the molecules of the polar materials, like water, fat, and protein, for thermal energy in such a way that the food can be heated.

However, the bottom side of the box fully contacts the internal bottom side of the microwave oven, the lower part of the food that is close to the bottom side of the box fails to be directly irradiated by the microwave and the microwave needs to penetrate through the upper art of the food to heat the lower part of the food. For this reason, the microwave on such path has been attenuated to enable the lower part of the food to be ineffectively heated to further cause inequable heating of the whole food in such a way that the food may not be fully cooked. In this way, the food may need to be microwaved again to incur waste of energy and time and even the box may be overheated to bring forth toxins to further pollute the food.

SUMMARY OF THE INVENTION

The primary objective of the present invention is to provide a microwavable container, which can uniformly heat the food therein by a microwave generated by the microwave oven.

The foregoing objective of the present invention is attained by the microwavable container for receiving food and to be put into a microwave oven for microwave heating. The microwave oven includes a support surface for supporting the microwavable container. The microwavable container is composed of a main body and a support member. The main body includes an internal bottom wall and an internal peripheral wall, both of which jointly define a chamber for receiving the food. The support member is provided with a predetermined height and located at a bottom side of the main body in such a way that a gap is formed between the internal bottom wall of the main body and the support surface of the microwave oven while the container is placed into the microwave oven. In this way, the microwave can pass through the gap to heat where the food is close to the internal bottom wall of the container.

DETAILED DESCRIPTION OF PREFERRED EMBODIMENTS

Figure 1:
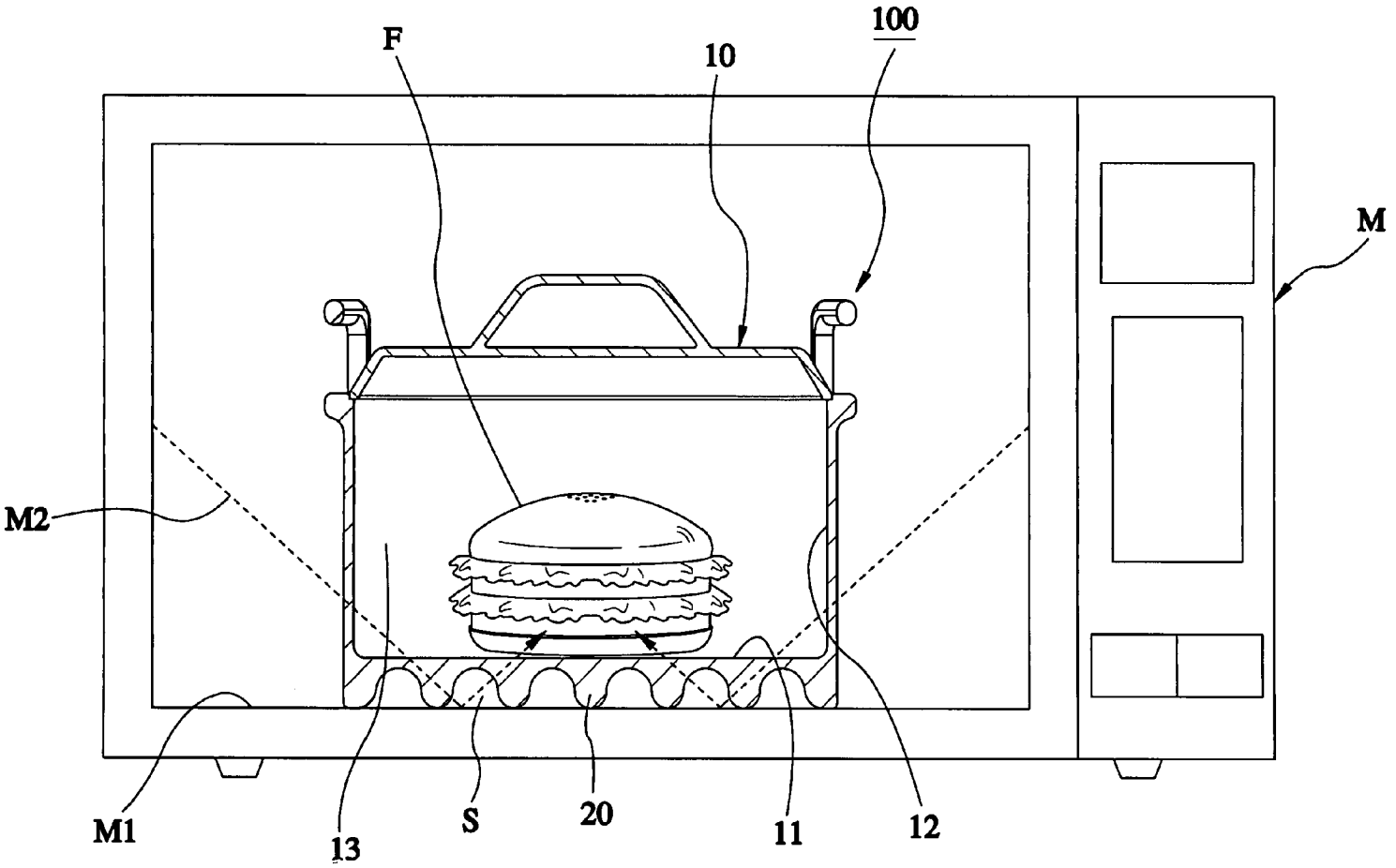
FIG. 1 is a schematic view of a first preferred embodiment of the present invention.

Referring to FIG. 1, a microwavable container 100 constructed according to a first preferred embodiment of the present invention can receive food F and be placed into a microwave oven M for microwave heating. The microwave oven M includes a support surface M1 for supporting the microwavable container 100 while it is put thereon. The microwavable container 100 is composed of a main body 10 and a support member 20.

The main body 10 is made of a microwavable material, like polypropylene, and includes an internal bottom wall 11 and an internal peripheral wall 12, both of which jointly define a chamber 13 for receiving the food F.

The support member 20 is made of a microwavable material, like polypropylene, connected with a bottom side of the main body 10 in one piece, and located between the internal bottom wall 11 of the main body 10 and the support surface M1 of the microwave oven M. In this embodiment, the support member 20 has a wavy bottom side to come up with a gap S between he internal bottom wall 11 and the support surface M1. The height of the support member 20 is preferably more than 1 cm and optimally 1-5 cm. In this way, a partial microwave M2 can enter and pass through the gap S to work on the food F inside the chamber 13 to allow the food F to be fully heated by the microwave M2. Alternatively, the support member 20 can be independent from the main body 10.

Figure 2:
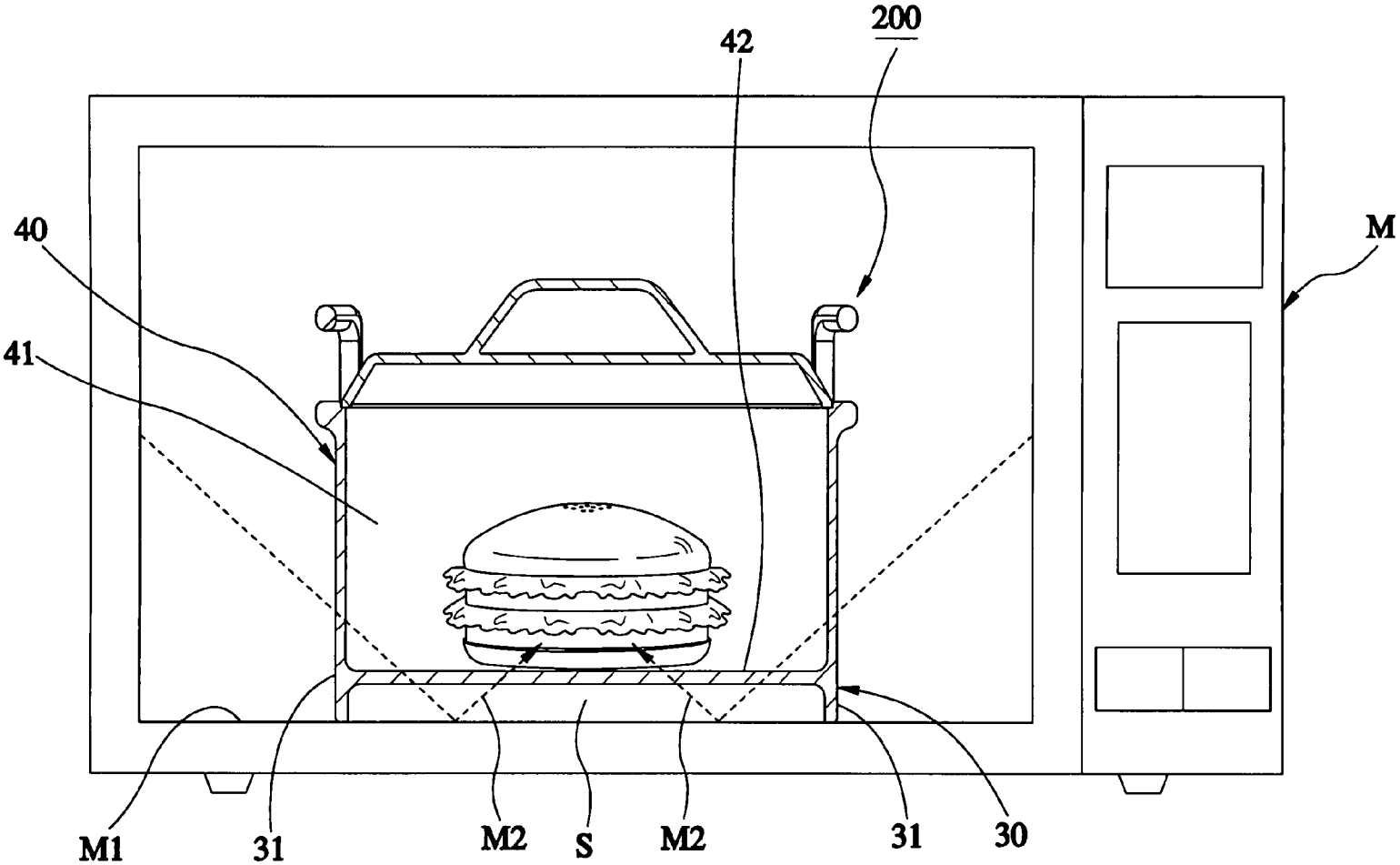
FIG. 2 is a schematic view of a second preferred embodiment of the present invention.

Referring to FIG. 2, a microwavable container 200 constructed according to a second preferred embodiment of the present invention is similar to that of the first embodiment, having the following difference. The support member 30 further includes three props 31. Each of the props 31 has two ends, one of which is connected with the bottom side of the main body 40 in one piece and the other contacts the support surface M1 of the microwave oven M. In this way, the microwave M2 can pass through the gap S between the support surface M1 and the internal bottom wall 42 to enter the chamber 41 and to work on the food F, such that the food F can likewise be uniformly heated.

Figure 3:
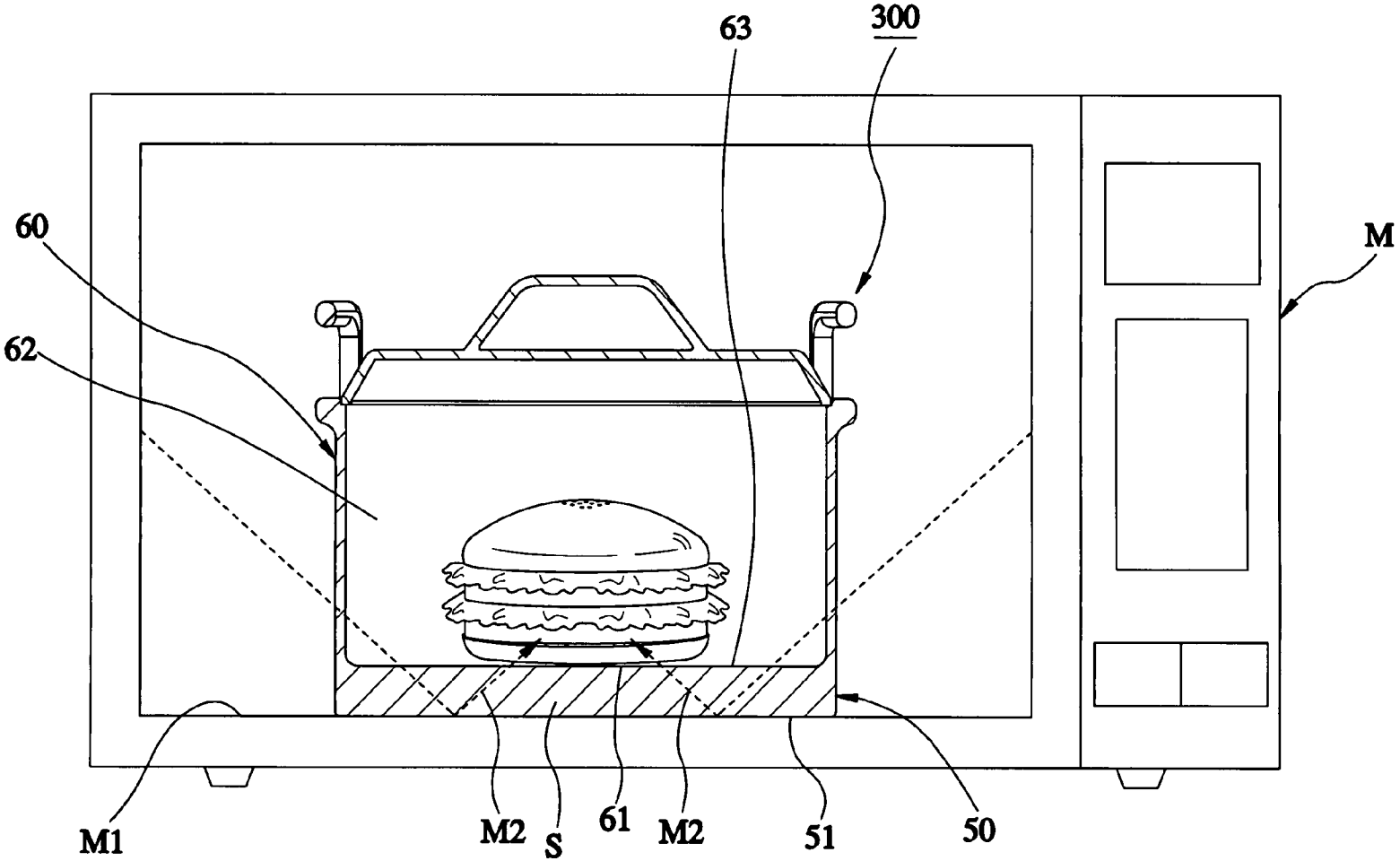
FIG. 3 is a schematic view of a third preferred embodiment of the present invention.

Referring to FIG. 3, a microwavable container 300 constructed according to a third preferred embodiment of the present invention is similar to those of the aforesaid embodiments, having the following difference. The support member 50 protrudes downward for a predetermined height, which is preferably more than 1 cm, from a bottom side 61 of the main body 60, having a flat bottom side 51 for full contact with the support surface M1 of the microwave oven M. In this way, the microwave M2 can pass through the gap S between the support surface M1 and the internal bottom wall 63 to enter the chamber 62 and to work on the food F, such that the food F can likewise be uniformly heated.

In conclusion, the support member of the present invention can space the food from the support surface of the microwave oven for a predetermined height to allow the microwave to pass through the gap to enter and work on the food in the chamber, such that the lower part of food where is close to the bottom side of the chamber can be microwaved and the whole food can be uniformly heated for preferable cooking effect.

Although the present invention has been described with respect to specific preferred embodiments thereof, it is in no way limited to the specifics of the illustrated structures but changes and modifications may be made within the scope of the appended claims.

What is claimed is:

1. A microwavable container for receiving food and for microwave heating in a microwave oven, the microwave oven having a support surface for supporting the microwavable container, the container comprising:

a main body having an internal bottom wall which has a flat surface and an internal peripheral wall, the internal bottom and peripheral walls jointly defining a chamber in which the food can be placed;

a support member having a predetermined height and located at a bottom side of the main body, whereby a gap is formed between the internal bottom wall of the main body and a support surface of a microwave oven, while the microwavable container is put into a microwave oven, in such a way that a microwave generated by the microwave oven can pass through the gap to enter the chamber and heat the food; and wherein the support member is solid and comprises a flat upper surface and a bottom side which is wavy in sectional view.

2. The microwavable container as defined in claim 1, wherein the support member is higher than 1 cm.

3. The microwavable container as defined in claim 2, wherein the support member is provided with a height of 1-5 cm.

4. The microwavable container as defined in claim 1, wherein the support member is connected with the bottom side of the main body as a unitary member.

5. The microwavable container as defined in claim 1, wherein the support member protrudes downward for a predetermined height from the bottom side of the main body.

6. The microwavable container as defined in claim 5, wherein the support member is higher than 1 cm.

7. The microwavable container as defined in claim 5, wherein the support member comprises a flat bottom side.

8. The microwavable container as defined in claim 1, wherein the support member is composed of three props having two ends, one of which contacts the bottom side of the main body and the other contacts the support surface of the microwave oven.

9. The microwavable container as defined in claim 8, wherein the support member is connected with the bottom side of the main body in one piece.

10. The microwavable container as defined in claim 1, wherein the wavy bottom sides come into contact with the support surface.

* * * * *